US005243822A

United States Patent [19]

Vismara

[11] Patent Number: 5,243,822

[45] Date of Patent: Sep. 14, 1993

[54] HYDRAULIC ROTARY PUMP-TURBINE AS A TORQUE CONVERTER

[76] Inventor: Angelo Vismara, Via Priv. R. Vitali, 5, Mariano Comense (Como), Italy

[21] Appl. No.: 776,356

[22] PCT Filed: May 22, 1990

[86] PCT No.: PCT/IT90/00055

§ 371 Date: Nov. 15, 1991

§ 102(e) Date: Nov. 15, 1991

[87] PCT Pub. No.: WO90/14518

PCT Pub. Date: Nov. 29, 1990

[30] Foreign Application Priority Data

May 23, 1989 [IT] Italy ..... 20608 A/89

[51] Int. Cl.[5] ..... F16D 39/00

[52] U.S. Cl. ..... 60/489; 60/491; 60/487; 418/31

[58] Field of Search ..... 60/487, 489, 490, 491, 60/357; 418/31; 92/12.1, 58, 72

[56] References Cited

U.S. PATENT DOCUMENTS

| | | | |
|---|---|---|---|
| 2,145,872 | 2/1939 | Glenn | 60/490 |
| 2,159,941 | 5/1939 | Guinness | 418/31 |
| 2,311,162 | 2/1943 | Bois . | |
| 3,187,676 | 6/1965 | Hartmann . | |
| 3,567,347 | 3/1971 | Scott | 418/31 |
| 3,598,455 | 8/1971 | Schmitz | 418/31 X |
| 3,740,954 | 6/1973 | Young | 60/489 |
| 4,901,529 | 2/1990 | Iino et al. | 60/487 X |

FOREIGN PATENT DOCUMENTS

| | | | |
|---|---|---|---|
| 785646 | 6/1972 | Belgium . | |
| 406113 | 11/1924 | Fed. Rep. of Germany | 60/488 |
| 481546 | 9/1916 | France . | |
| 1168253 | 12/1958 | France . | |
| 2400125 | 4/1979 | France | 418/31 |
| 0140605 | 12/1978 | Japan | 418/31 |
| 0129187 | 6/1988 | Japan | 418/31 |
| 0256892 | 10/1990 | Japan | 418/31 |
| 234209 | 5/1925 | United Kingdom | 60/489 |

*Primary Examiner*—Edward K. Look
*Assistant Examiner*—Hoang Nguyen
*Attorney, Agent, or Firm*—Panitch Schwarze Jacobs & Nadel

[57] ABSTRACT

A variable flowrate and variable pressure oil operated hydraulic rotary pump turbine, having radial blades, comprised of an oil tight casing (1) full of fluid, holding therewithin a rotor (2) provided with slots wherein blades (3) are slidably mounted. The blades having pivot pins and rings are guided in their motion by positive cams (7) machined in the casing cover. In the portion where the blades project the most out of the rotor, a sector (4) having semicylindrical cavity and whose motion is controlled by a camshaft (6) changes its distance relative to the blades whereby, in the pumping action, the fluid flowrate and pressure are modified. The camshaft is actuated by a lever with a centrifugal magnetic or electronic controller sensitive to the pump rotor RPM. The variable flowrate and variable pressure pump, connected through a fluid flow distributor and inverter member to one or more turbines identical to the pump, performs a torque conversion, replacing the mechanical clutch and shift gear in motor vehicles.

5 Claims, 5 Drawing Sheets

Fig. 8
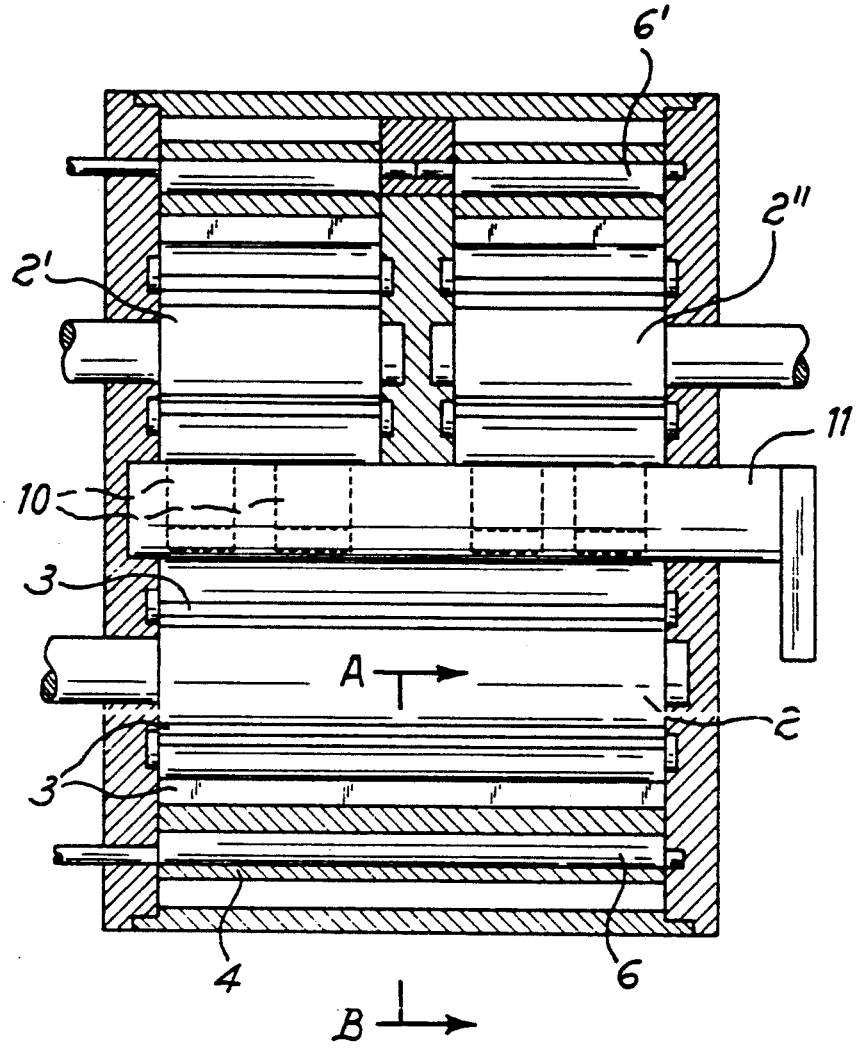
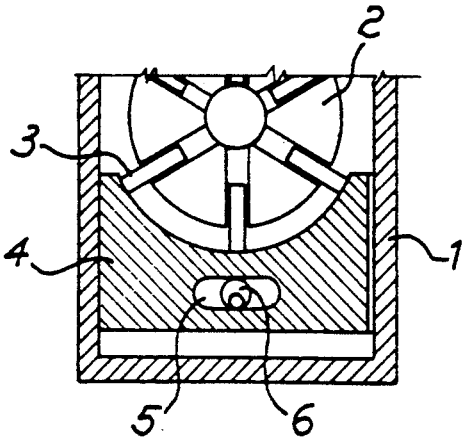
Fig. 8a

HYDRAULIC ROTARY PUMP-TURBINE AS A TORQUE CONVERTER

This invention concerns an oil-operated hydraulic rotary pump-turbine having constrained motion radial blades, and provided with a moving parallelepipedal member having a semicylindrical cavity, which member, by changing the distance thereof relative to the blades by means of a camshaft, changes the fluid flowrate and pressure.

Variable flowrate and variable pressure oil operated hydraulic rotary pumps are already known wherein, by changing the eccentricity of the jacket contacted by the blade edges, the fluid flowrate is modified, or axial or radial piston oil-operated hydraulic pumps where the piston stroke is changed. These pumps have the advantage of precisely changing the fluid flowrate they provide to the oil operated hydraulic motors (turbines) while leakages are kept to a minimum, and they have proved very useful for servo-control as well as for remote control, but they are not suitable as torque converters for motor vehicles.

Such oil operated hydraulic rotary pumps are known, for example, from FR-A-1 168 253 wherein rotors with sliding radial blades are described, which blades may constrainedly be controlled by positive cams and rotate in contact with confronting movable semicylindrical surfaces. This invention relates to a variable flowrate and variable pressure, oil-operated hydraulic rotary "pump-turbine", having constrained motion radial blades, and provided with a moving parallelepipedal member having a semicilindrical cavity, which member, by changing the distance relative to the blades, modifies the fluid flowrate and pressure. This pump, when connected to oil-operated hydraulic rotary motors having radial blades (turbines) identical to said pump, provides a torque variation which enables it to replace the clutch, the mechanical shift gear, or the hydraulic transmission, the Hydromatic converter, or the belt converter having variable diameter pulleys (Variomatic), in motor vehicles.

The pump-turbine according to this invention will be described in detail in the following, referring to the attached drawings of a possible embodiment thereof.

FIG. 8 shows a pump-turbine connected, through a distributor-inverter to a pair of identical turbines, to obtain the effect of a differential gear; and FIG. 8*a* is a cross section along line A-B of FIG. 8.

Figure 1:
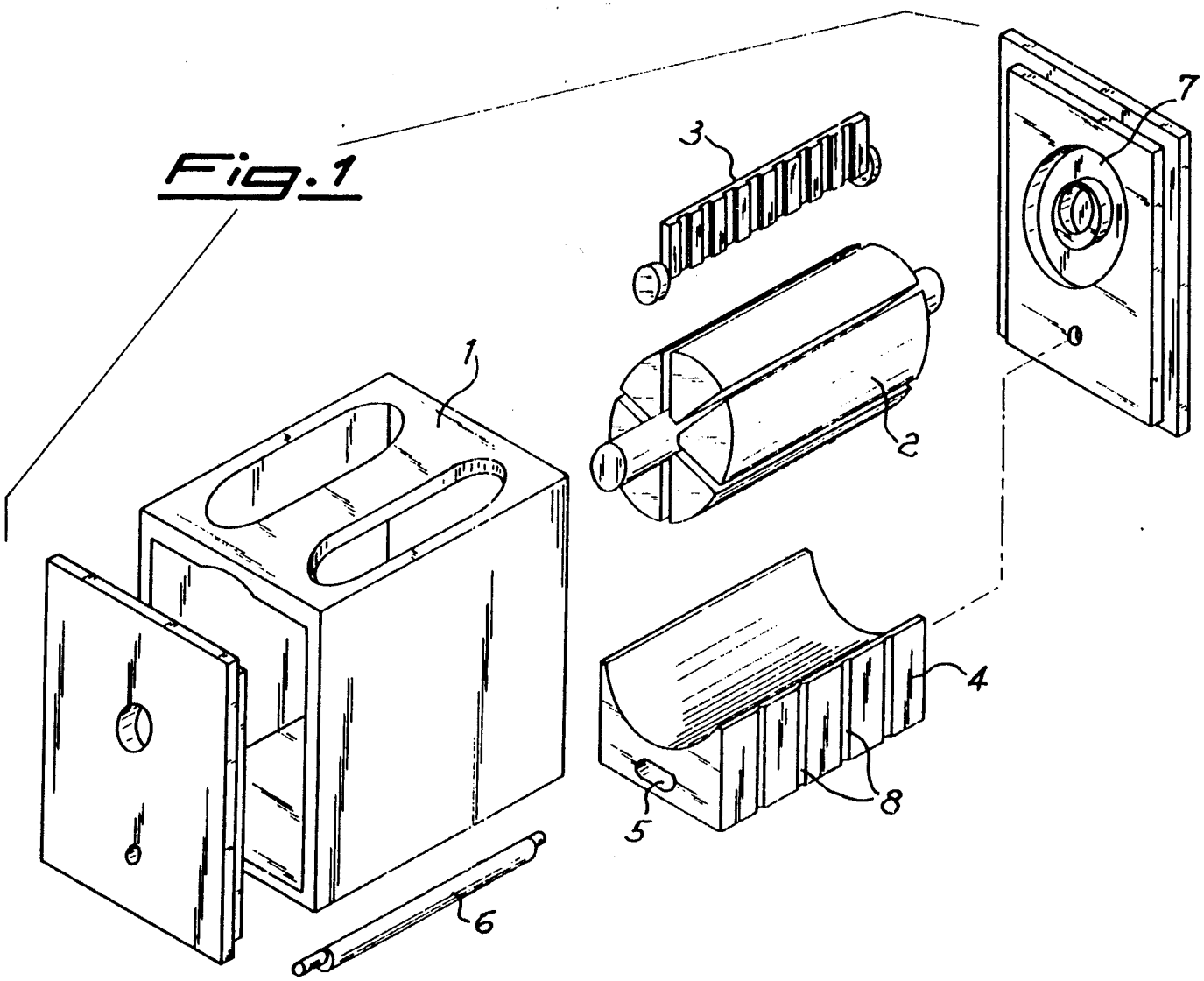
FIG. 1 is an exploded perspective view showing the pump-turbine basic components.

As it is apparent from FIG. 1, the pump-turbine according to this invention includes a parallelepipedal casing 1 having on the upper surface thereof two openings for operating fluid inlet and outlet, while a pair of opposite removable walls are provided on the inside with a positive cam cavity 7 and with a pair of cavities adapted to receive a rotor shaft 2 and a shaft bearing an off-center cam 6 controlling the reciprocating motions of a sector or member 4 provided with a semicylindrical cavity and with lateral grooves 8 acting as compensating throughflow passages for the operating fluid. Rotor 2 is radially provided with six longitudinally directed slots wherein the same number of flat blades 3 are received, said blades being provided with end pivot pins which are in turn provided with ball or roller bearings adapted to roll within the two opposite cavities 7 used as positive cams.

Figure 2:
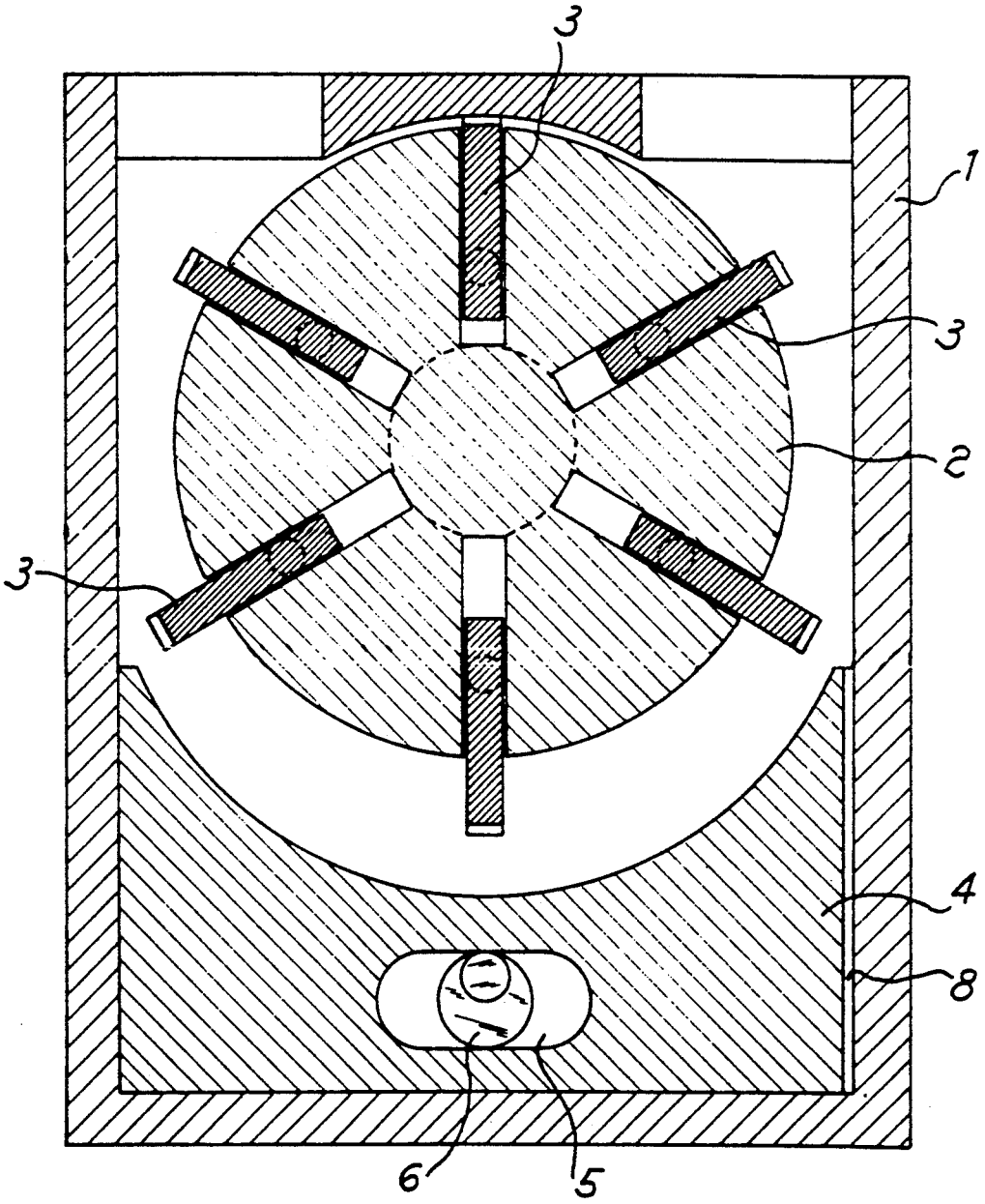
FIG. 2 is a pump-turbine cross section showing a sector provided with a cavity and spaced apart from the blades.
Figure 3:
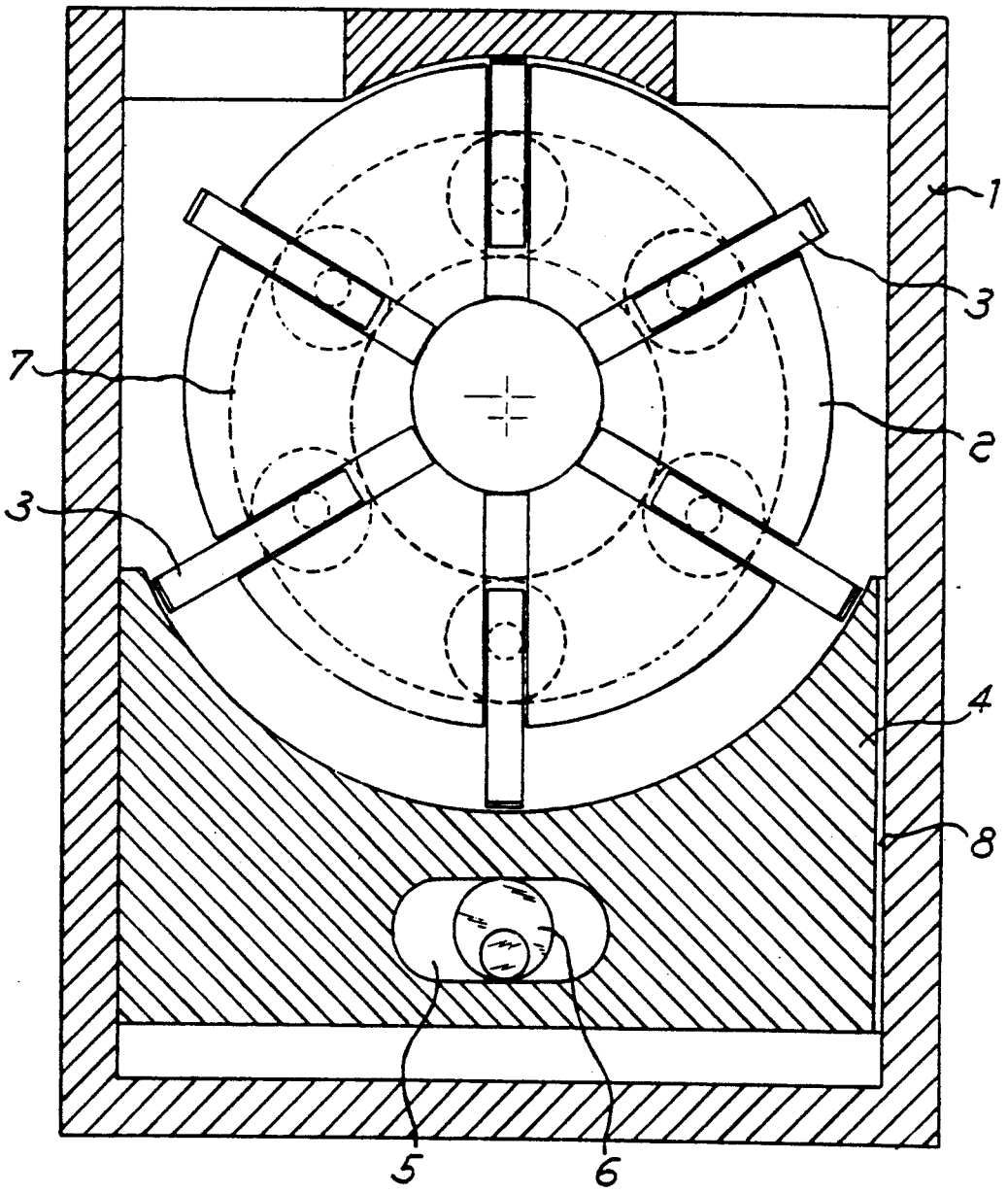
FIG. 3 is the same pump turbine section of FIG. 2, showing the sector provided with a semicylindrical cavity in the position thereof closest to the blade tips.
Figure 4:
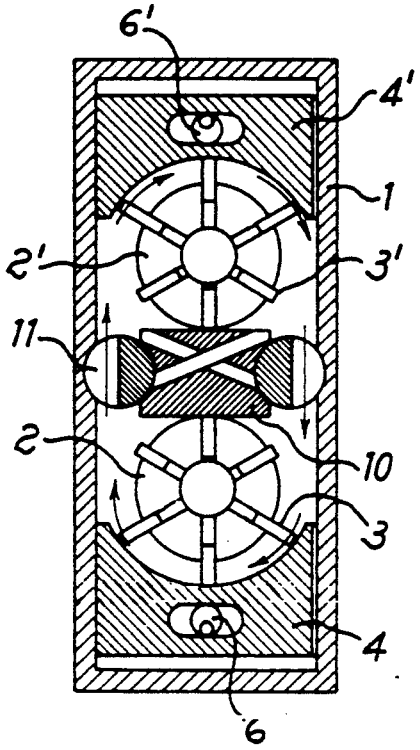
FIG. 4 shows in a reduced scale the pump connected to an identical pump-turbine, through a distributor-inverter, in a forward gear position.
Figure 6:
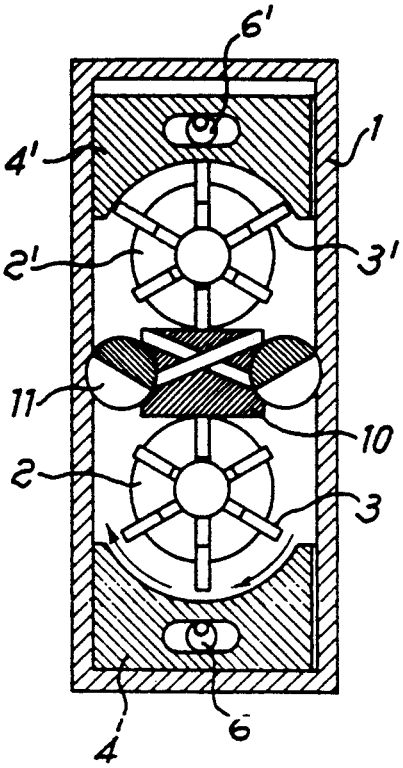
FIG. 6 is the equivalent of FIG. 4, showing the pump hollow sector moved apart from the blades.
Figure 5:
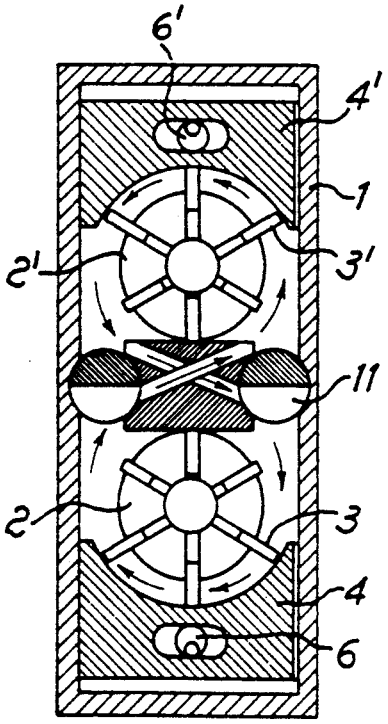
FIG. 5 is the equivalent of FIG. 4, but in a reverse gear position.
Figure 7:
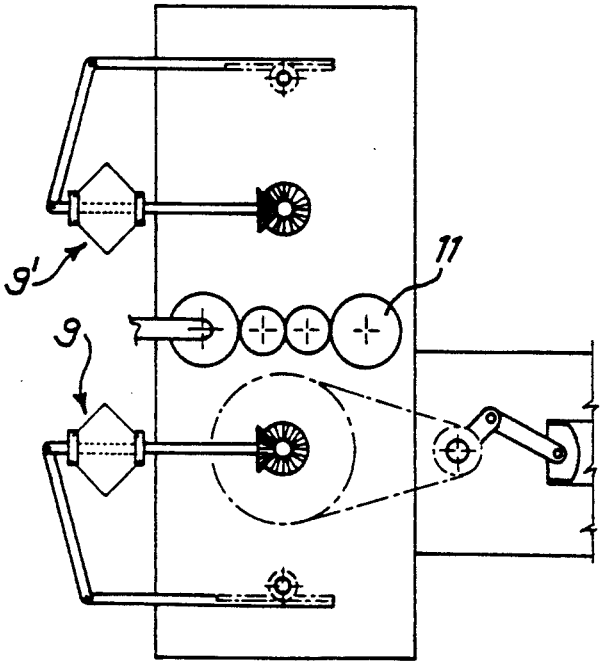
FIG. 7 shows schematically the assembly of FIG. 4, connected to the engine of an automotive vehicle.

FIG. 2 shows the cross section of a pump-turbine according to this invention comprising the box-like casing 1 receiving therein rotor shaft 2 provided with radial slots wherein blades 3 are slidingly mounted while being provided with pivot pins and roller bearings or rings; a lower parallelepipedal sector 4 provided with a semicylindrical cavity facing rotor 2 and moving under the action of a shaft bearing an off-center cam 6, received within a through opening 5 in hollow sector 4. The ends of rotor shaft 2 and of camshaft 6 are received in the end covers of box-like casing 1. In FIG. 3 the hollow sector is at a close distance relative to the blade tips, while the curve of the positive cams machined on the casing end covers is shown by dashed lines 7.

A motor vehicle engine provides motion, at a reduced number of RPM, to pump 2 connected through a crossing channel distributor-inverter 10, to one or more oil operated hydraulic motors 2', 2'' (turbines). The pump, the distributor, the channels, the turbine are full of hydraulic fluid (a transmission oil).

When the vehicle engine and therefore the pump as well are running at low RPM, moving hollow sector 4 is spaced apart from blades 3 which slide on the fluid, pump 2 is running idle with a low pressure without supplying fluid to the turbines, the engine runs in "idle" and the vehicle is at standstill. When the RPM of the engine, and therefore of the pump are increased, hollow sector 4 displaced by cam 6 which is in turn actuated by controller 9, comes closer to the blades, the flowrate and the pressure increase, the fluid is accelerated towards turbine 2' which starts turning and partially picks up speed. Simultaneously, and proportionally to the increase of the RPM of turbine 2', controller 9' connected thereto starts operating and, through suitable linkages, displaces the camshaft and brings sector 4', provided with a semicircular cavity, closer to blade 3'. The slip of blades 3, 3' sliding relative to the fluid gets smaller, the RPM of the turbine-wheel 2, 2' and the vehicle speed progressively increases. The speed gets automatically adjusted as a function of load, slope, and horsepower and RPM of the vehicle engine. The long edge of the blades projecting out of the pump and turbine rotors does not contact the semicircular cavities, but it must remain a few hundredths of a mm apart when the moving sector has come the closest to the blades; this is in order to eliminate friction and to allow a minimum slip between blades and fluid and to make the transmission more flexible. In order to obtain a good braking effect on the vehicle, the power of the engine is reduced, the engine slowing down in RPM causes the pump hollow sector to move apart whereby the pump runs "idle" and the channels of fluid distributor 10 controlled through valves 11 by the brake pedal, get closed.

I claim:

1. An oil operated hydraulic rotary pump-turbine comprising in a casing (1) a rotor (2, 2', 2'') with constrained blades (3, 3') radially movable through positive cams (7), and a substantially parallelpipedal member (4, 4') with a rotor-confronting semicylindrical cavity that is movable toward and away from the rotor (2, 2', 2'') by means of a cam device, said cam device being a shaft having an off-center cam acting on said parallelpipedal member (4, 4'), said constrained blades (3, 3') and said confonting semicylindrical cavity of the parallelpipedal member (4, 4') being spaced apart by a few hundredths of a millimeter when the constrained blades are closest to the confronting semicylindrical cavity and control means for actuating said shaft in response to the rotary speed of said rotor (2, 2', 2'').

2. A pump-turbine according to claim 1 coupled through a distributor-inverter member (10, 11) with at least an identical pump-turbine operating as a torque converter for automatic transmissions in motor vehicles.

3. A pump-turbine according to claim 1, coupled through a distributor-inverter member (10, 11) with at least an identical pump-turbine operating as a torque converter for automatic transmissions in motor vehicles.

4. An oil operated hydraulic rotary pump-turbine comprising in a casing (1), a rotor (2, 2', 2'') with constrained blades (3, 3') radially movable through positive cams (7), and a substantially parallelpipedal member (4, 4') with a rotor-confronting semicylindrical cavity that is movable toward and away from the rotor (2, 2', 2'') by means of a cam device, said cam device being a shaft having an off-center cam acting on said parallelpipedal member (4, 4'), and control means for actuating said shaft in response to the rotary speed of said rotor (2, 2', 2''), said rotary pump-turbine being coupled through a distributor-inverter member (10, 11) with at least a second identical pump-turbine operating as a torque converter for an automatic transmission in a motor vehicle.

5. The pump-turbine according to claim 4, characterized in that said distributor-inverter member (10, 11) is internally provided with at least two reciprocally crossing spaced apart channels (10) hydraulically connecting the rotors (2, 2', 2'') of said pump-turbines, and with two laterally symmetrical counter-rotating semicylindrical valves (11) which are mechanically connected to each other in synchronism.

* * * * *